US006647555B2

(12) United States Patent
Yamaguchi et al.

(10) Patent No.: US 6,647,555 B2
(45) Date of Patent: Nov. 18, 2003

(54) BELT-LIKE ARTICLE, AND NECK STRAP, HUNG-OBJECT-SUPPORTING BODY AND PRODUCT-STORING BODY USING THE SAME BELT-LIKE ARTICLE

(75) Inventors: Yoshiharu Yamaguchi, Toyama-ken (JP); Tsutomu Hamatani, Toyama-ken (JP); Yoshimichi Yamakita, Toyama-ken (JP); Ikuo Hirao, Tokyo (JP); Takashi Adachi, Tokyo (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/005,349

(22) Filed: Dec. 7, 2001

(65) Prior Publication Data

US 2002/0069451 A1 Jun. 13, 2002

(30) Foreign Application Priority Data

Dec. 8, 2000 (JP) ..... 2000-375042

(51) Int. Cl.[7] ..... A41F 19/00
(52) U.S. Cl. ..... 2/338; 2/301; 24/3.4; 24/3.3
(58) Field of Search ..... 2/338, 311, 312, 2/313, 314, 315, 316, 317, 318, 319, 321, 323, 336, 337, 301, 235, 236; 24/306, 390, 3.4, 3.3, 3.1, 3.13

(56) References Cited

U.S. PATENT DOCUMENTS

| | | | | |
|---|---|---|---|---|
| 1,900,490 A | * | 3/1933 | Famous | |
| 2,663,877 A | * | 12/1953 | Bohman | 2/239 |
| 2,819,650 A | * | 1/1958 | Seron | 351/156 |
| 3,073,367 A | | 1/1963 | Samara | |
| 3,106,717 A | * | 10/1963 | Cuvin | 2/70 |
| 3,751,732 A | * | 8/1973 | Mott | 2/230 |
| 3,848,270 A | * | 11/1974 | Rand | 2/311 |
| 3,908,875 A | * | 9/1975 | Wilson et al. | 224/5 |
| 3,920,166 A | * | 11/1975 | Hogensen, Jr. | 224/5 |
| 3,977,638 A | * | 8/1976 | Woodard | 248/102 |
| 4,024,608 A | * | 5/1977 | Brewer | 24/547 |
| 4,058,853 A | * | 11/1977 | Boxer et al. | 2/239 |
| 4,063,313 A | * | 12/1977 | Hagios | 2/338 |
| 4,126,902 A | * | 11/1978 | McKenna | 2/338 |
| 4,136,934 A | * | 1/1979 | Seron | 351/157 |
| 4,151,936 A | * | 5/1979 | Hawkes | 224/224 |
| 4,320,863 A | * | 3/1982 | Lyer et al. | 224/259 |

(List continued on next page.)

FOREIGN PATENT DOCUMENTS

| | | |
|---|---|---|
| EP | 0 688 515 A1 | 12/1995 |
| JP | S57-20210 | 2/1982 |
| JP | S57-47921 | 10/1982 |
| JP | S62-20415 | 4/1985 |
| JP | S62-174416 | 11/1987 |

*Primary Examiner*—John J. Calvert
*Assistant Examiner*—Alissa L. Hoey
(74) *Attorney, Agent, or Firm*—Finnegan, Henderson, Farabow, Garrett, & Dunner, L.L.P.

(57) ABSTRACT

A belt-like article has fastening elements continuous attached along an entire periphery of a long tape main body. The belt-like article further includes engaging means capable of engaging with/disengaging from each other, each of which has an engaging portion provided at a predetermined position in a longitudinal direction of the tape main body. By winding the belt-like article spirally about an end portion thereof so as to engage the opposing fastening elements successively, a diversified types of the storage bodies can be obtained. Further, by engaging the engaging means with each other, the belt-like article can be used as a neck strap for hanging the storage body for accommodating an object. Therefore, the belt-like article is provided with not only an application as the belt-like article but also an application as a storage body for various objects, which are functionally related to each other, so that it can be used sufficiently for practical purpose.

10 Claims, 14 Drawing Sheets

U.S. PATENT DOCUMENTS 4,404,689 A * 9/1983 DeWan ..... 2/247
4,446,997 A * 5/1984 Himberg ..... 224/578
4,471,509 A * 9/1984 Marks ..... 24/3.3
4,697,288 A * 10/1987 Palumbo ..... 2/269
4,710,983 A * 12/1987 Markoff ..... 2/301
5,033,127 A * 7/1991 Schmeltz ..... 2/269
5,299,682 A * 4/1994 Tatar ..... 206/5
5,358,159 A * 10/1994 Lundie, Jr. ..... 224/624
5,409,151 A * 4/1995 Freimark ..... 224/148.6
5,460,308 A * 10/1995 Hahn ..... 224/257
5,465,466 A * 11/1995 Napier ..... 24/3.3
5,680,679 A * 10/1997 May ..... 24/3.2
5,819,320 A * 10/1998 Jolla ..... 2/236
5,878,443 A * 3/1999 Seiler ..... 2/426
5,970,526 A * 10/1999 Weathers ..... 2/321
5,974,591 A * 11/1999 Leslie ..... 2/323
6,230,331 B1 * 5/2001 Aguilar et al. ..... 2/209.11
6,311,336 B1 * 11/2001 Gootrad ..... 2/251
6,339,848 B1 * 1/2002 Mayhood et al. ..... 2/338
6,378,746 B1 * 4/2002 Miller ..... 224/258
6,449,775 B1 * 9/2002 Battaglia ..... 2/312

* cited by examiner

BELT-LIKE ARTICLE, AND NECK STRAP, HUNG-OBJECT-SUPPORTING BODY AND PRODUCT-STORING BODY USING THE SAME BELT-LIKE ARTICLE

BACKGROUND OF THE INVENTION

1. Field of the Invention

The present invention relates to a belt-like article and a product-storing bag as well as a hanging device for various kinds of objects using the same belt-like article.

2. Description of the Related Art

Conventionally, it has been well known to obtain a storage body for small objects by attaching fastening elements of a slide fastener or male/female fastening elements for snap engagement continuously on an entire periphery of a thick tape body and spirally engaging the opposing fastening elements with each other, which is disclosed by, for example, Japanese Utility Model Application Laid-Open No. 57-47921, Japanese Utility Model Application Laid-Open No. 57-20210, Japanese Utility Model Application Laid-Open No. 62-174416, Japanese Utility Model Publication No. 62-20415 and U.S. Pat. No. 4,710,983.

According to these publications, a length of the aforementioned belt-like article and a first position in which the corresponding fastening elements are engaged with each other may be changed so that various shapes of storage bodies, such as a triangular pyramid, a rectangular box, an elongated prism having a rectangular section or the like can be obtained.

However, the storage bodies disclosed in the above described publications have been invented in order to achieve an unexpectedness that they are obtained by successively engaging the fastening elements attached continuously along a periphery of the belt-like article having the above-described structure successively. This belt-like article does not have any other special function than being employed as an ordinary waist belt. Therefore, an interest in such an unexpectedness is likely to be lost in a short period, and it did not lead to a continuing application. Thus, this belt-like article has not been developed to get to a practically usable stage.

SUMMARY OF THE INVENTION

Accordingly, an object of the present invention is to provide a belt-like article which not only has an unexpectedness but also can be employed for practically meaningful purposes in which an application as the belt-like article and an application as a storage body for various objects are functionally combined with each other, and various kinds of products intimately and functionally related with the belt-like article.

To achieve the above object, according to a first aspect of the present invention, there is provided a belt-like article having fastening elements continuously attached along an entire periphery of a long tape main body, further comprising: engaging means having engaging portions capable of engaging with/disengaging from each other, provided at a predetermined position in a longitudinal direction of the tape main body. The "entire periphery" of the tape mentioned in this specification does not mean a completely entire periphery of the tape main body, but includes a case where the there is a portion having no fastening element. Further, it also includes a case where the engaging means having the engaging portions serve to engage front faces or rear faces of the belt-like article, as well as a case where the engaging means serve to engage the front face with the rear face.

The belt-like article of the present invention has a conventionally known basic structure. That is, it comprises a tape main body of a predetermined length and fastening elements disposed continuously along the entire periphery thereof. The tape main body is made of a knitted tape, an unwoven tape, a tape made of a synthetic resin sheet or a tape made of natural leather or synthetic leather. The fastening element used in the present invention may be the one that is to be attached to an ordinary slide fastener, a snap button made of metal or synthetic resin having an ordinary structure, or a snapping device which is composed of a combination of female or socket-like and male or plug-like fastening elements, these fastening elements being pressed to or inserted into each other so as to be engaged with each other by snap action.

Further, according to the present invention, the above mentioned fastening elements may be a plurality of male and female fastening elements, and compose a surface fastener provided with engaging members for making plane contact with each other by being pressed, the engaging members having a plurality of male and/or female engaging elements.

The belt-like article having such a structure according to the present invention is characterized in that there are provided the engaging means, which can engage with or disengage from each other, at predetermined positions in the longitudinal direction of the aforementioned tape main body.

The belt-like article of the present invention having such a structure may be hung around a neck as a ring-like neck strap in a state where the engaging means being engaged with each other. The neck strap may be used as an accessory, or may be used for hanging a portable phone or the like on the neck strap by inserting the neck strap through an end portion of a narrow strap attached to the portable phone or the like. Then, if it is intended to store the portable phone or the like, the belt-like article is wound spirally about a region of a predetermined length at an end portion of the belt-like article so as to engage opposing fastening elements successively, thereby producing a storage body for an object. That is, the belt-like article serves to be not only a storage case for an object but also a hanging device for such an object, so that it has both functions for carrying the object and as an assisting device during use thereof.

It is preferable that the tape main body has a covering body capable of covering/exposing the engaging portion of the engaging means disposed on a rear face thereof. As for the engaging means disposed at predetermined positions in the longitudinal direction of the belt-like article, the engaging portion of one of the engaging means is exposed on the rear face side of the tape main body. If said engaging portion is made of metal, it may abut or make a sliding contact with an object stored inside when the belt-like article is used as an object storage case. As a result, the surface of the object may be damaged when being thus contacted.

Thus, according to the present invention, if it is intended to use the belt-like article as a storage body for example, the engaging portion of the engaging means exposed on the rear face of the tape is covered with a covering body. On the other hand, if it is intended to use the belt-like article as a neck strap for example, the covering body is removed so that the belt-like article can be provided with a function as the engaging means. The covering body may be composed of, for example, a surface fastener with a female tape piece having a plurality of fine loop-like fastening elements provided on a surface of a female member. An end of the female tape piece is attached to a rear face of the tape main body adjacently to the engaging portion. A male tape piece having a plurality of fine hook-like fastening elements on a surface thereof is attached on an opposite side of the engaging portion on the rear face of the tape main body.

Further, according to the present invention, it is preferable that a short strip-like tape piece is attached to the surface of the tape main body. The short strip-like tape piece may be completely attached thereto by sewing, or may be attached so as to be detachable by means of, for example, a snap button.

If the short strip-like tape piece is attached to the belt-like tape main body of the belt-like article, when the belt-like article is used as the storage body, for example, a belt may be inserted into a space formed between the tape piece and the surface of the tape main body so as to hold the storage body. Therefore, when the belt with the storage body is put on a waist portion, the storage body can be held at the waist portion. As a result, such a small object as a portable phone, a lighter or the like can be held at the waist portion and carried without being bulky.

Furthermore, according to the present invention, at least one of the engaging means has a joint device for joining another object. Consequently, another object can be joined to the belt-like article by the joint device. For example, with the engaging means provided in a center of the tape main body being engaged with the other engaging means having no joint device, it is possible to hung the belt-like article around the neck and carry another object. Alternatively, when the engaging means are provided at both end portions of the belt-like article and then, joint devices are attached to the engaging means respectively, for example, the joint devices may be attached to temples of glasses, so that the belt-like article may be hung around the neck as a glasses holding strap.

As evident from the above description, the belt-like article of the present invention may be sold independently. If any object is sold in combination with the belt-like article, a consumer would not have to buy a neck strap and a storage case independently of the object. Further, the belt-like article can be employed for diversified purposes in accordance with the kinds of the objects.

DESCRIPTION OF EMBODIMENTS

Hereinafter, embodiments of the present invention will now be described in detail with reference to the accompanying drawings.

Figure 1:
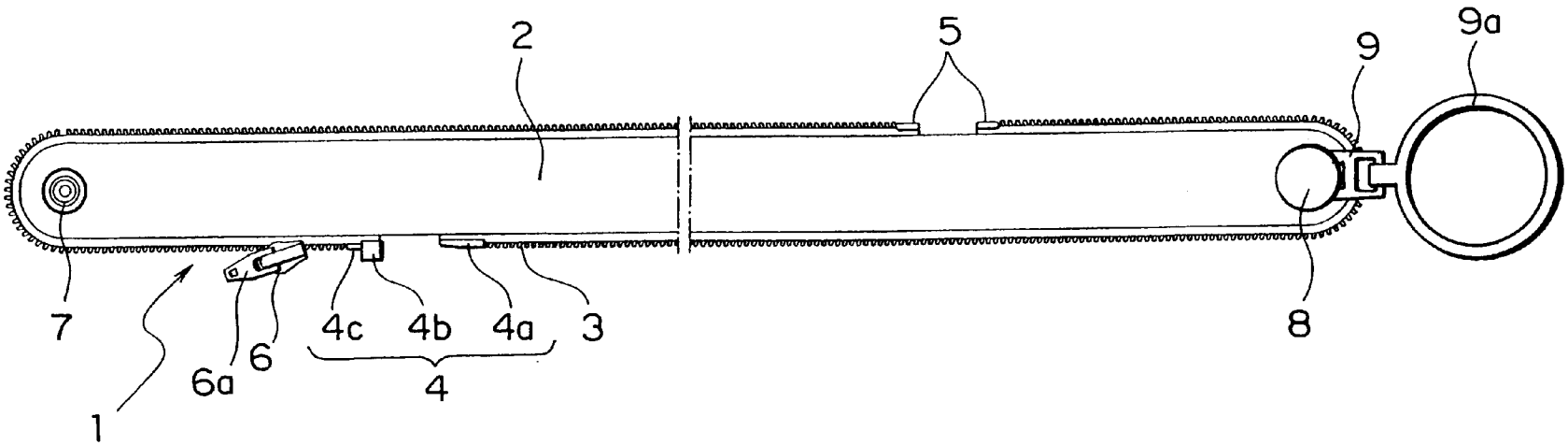
FIG. 1 is a front view of a belt-like article according to a typical embodiment of the present invention.
Figure 2:
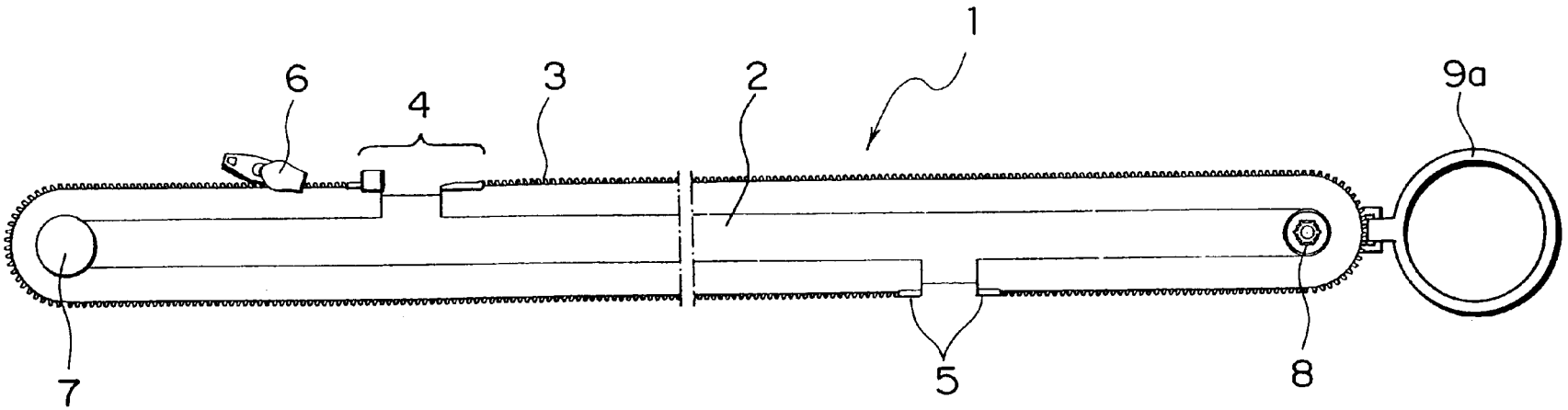
FIG. 2 is a rear view of the same belt-like article.

FIG. 1 is a front view of a belt-like article, showing an embodiment having a basic structure of the present invention, and FIG. 2 is a rear view thereof.

In a belt-like article 1 according to the illustrated embodiment, a plurality of fastening elements 3 are continuously disposed on and along a periphery of a tape main body 2 having a predetermined length and width as in the conventional manner. As for the tape main body 2, various kinds of fabric woven/knitted tapes, various kinds of tape-like unwoven cloth, synthetic resin tape, tape-like natural leather, tape-like synthetic leather and the like can be employed. These are selected appropriately depending on applications of the tape. For the fastening elements 3 to engage or release smoothly, both end portions in the longitudinal direction of the tape main body 2 are preferred to be formed in circular shapes respectively.

Each of the fastening elements 3 in the illustrated example is composed of a coupling element comprised of a leg portion attached to a side edge portion of a generally known fastener tape and an coupling head portion which engages a mating fastening element 3 This coupling element 3 may be made of metal or synthetic resin. The coupling elements made of synthetic resin may include a separate type in which individual coupling elements 3 are independent like ordinary metallic coupling elements and a continuous type. The continuous type includes, for example, coil-like elements in which a synthetic resin monofilament or the like is formed in a coil shape so that coupling head portions are formed at the respective parts of the coil portions so as to be linearly arranged, and zigzag-like elements in which a synthetic resin mono-filament is bent to be in a zigzag shape so that coupling heads are formed at ends of the respective bent portions.

The fastening elements in the present invention should not be limited to such coupling elements used for a slide fastener as mentioned above. For example, a snap device comprised of a well known snap button, which is to be snapped by pressing or insertion as disclosed in the aforementioned US publication, may be employed. Further, it is permissible to use a so-called surface fastener which is comprised of a plurality of fastening elements and plane-contacts with a mating one by pressing. In the case of the aforementioned snapping device, a plurality of male/female engaging members are attached continuously on a periphery of the tape main body 2 so as to correspond to engaging positions of the snapping device.

The coupling elements 3 of this embodiment are separate type made of synthetic resin, in which a plurality of the coupling elements 3 are attached to and along a side edge of the fastener tape at a predetermined pitch at the same time when they are molded, in the same manner as that of an ordinary slide fastener stringer. Then, the tape onto which the coupling elements 3 are attached continuously on a side edge thereof is sewed to an entire periphery of the tape main body 2.

In this embodiment, a separable bottom end stop 4, which is a kind of a lower stopper device of a slide fastener and can be engaged or released, is attached to a coupling-element-attaching position at a side edge of the belt-like article 1 obtained in the above-described manner. The coupling-element-attaching position is a predetermined position inward from one end of the tape-like article 1 in the longitudinal direction thereof. Then, an upper stopper device 5 of the slide fastener is attached on the other side edge of the belt-like article 1 at a position on a diagonal line extending from the fixing position of the separable bottom end stop 4. Thus, the coupling elements 3 located at the attaching positions of the separable bottom end stop 4 and the upper stopper device 5 are not attached or removed.

The aforementioned separable bottom end stop 4 is comprised of an insert pin 4*a* and a box pin 4*c* fixed to a box body 4*b*, both of which are attached on a separable-bottom-end-stop attaching portion of the belt-like article 1 in an opposing state, likewise a known structure of a slide fastener provided with a separable bottom end stop attached on an ordinary jumper or the like. A slider 6 is attached so as to be slidable on the coupling elements 3, 3, . . . on the side of the box pin 4*c*. The aforementioned upper stopper device 5 is attached adjacently to each coupling element 3 which is located at each of the ends of a row of the coupling elements 3 and spaced from each other at a coupling element removal position of the attaching position of the upper stopper device 5.

Figure 5:
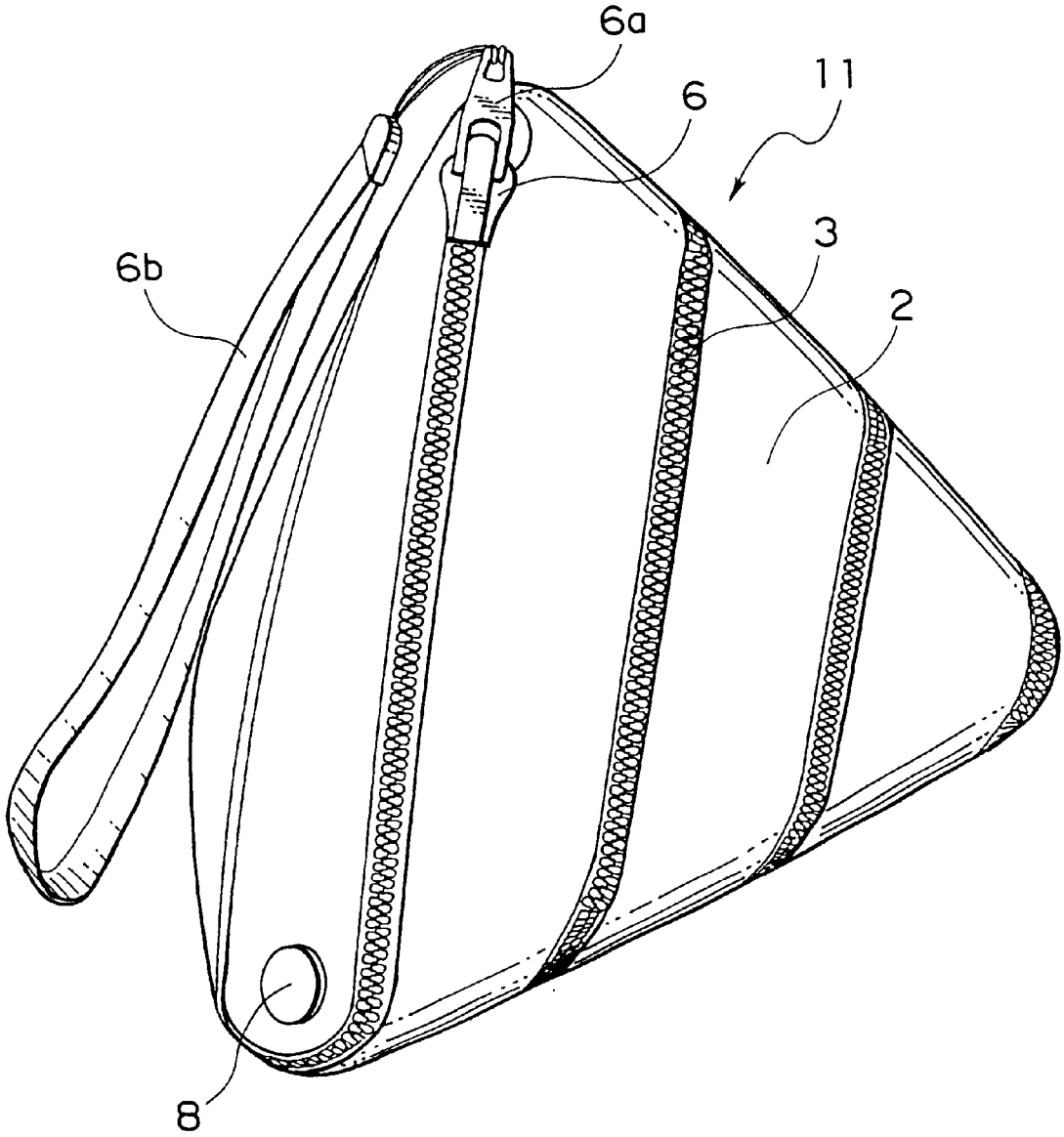
FIG. 5 is a solid view showing an example of a triangular pyramid-like storage body that can be obtained from the belt-like article.
Figure 6:
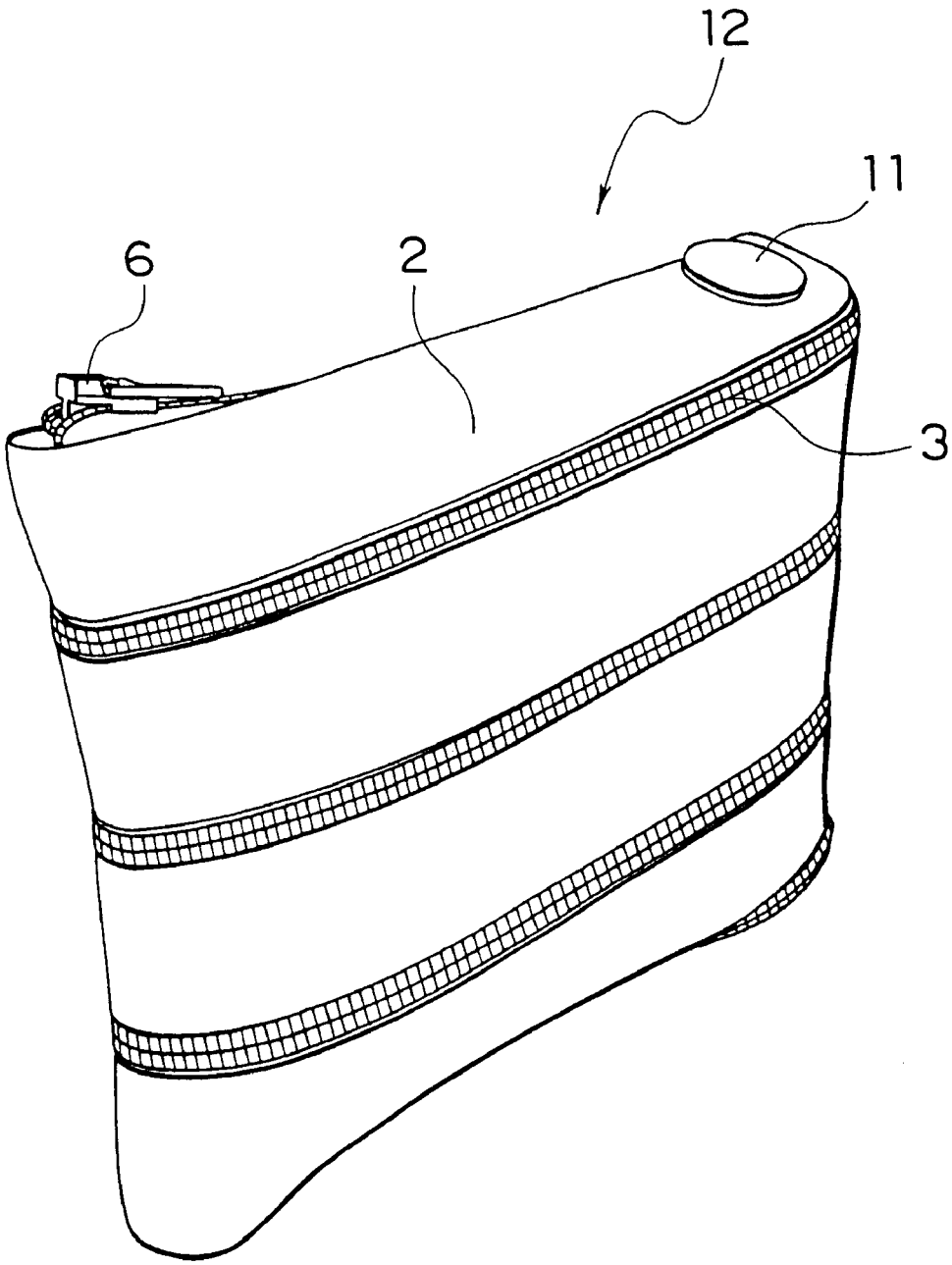
FIG. 6 is a solid view showing an example of a rectangular box-like storage body.
Figure 7A:
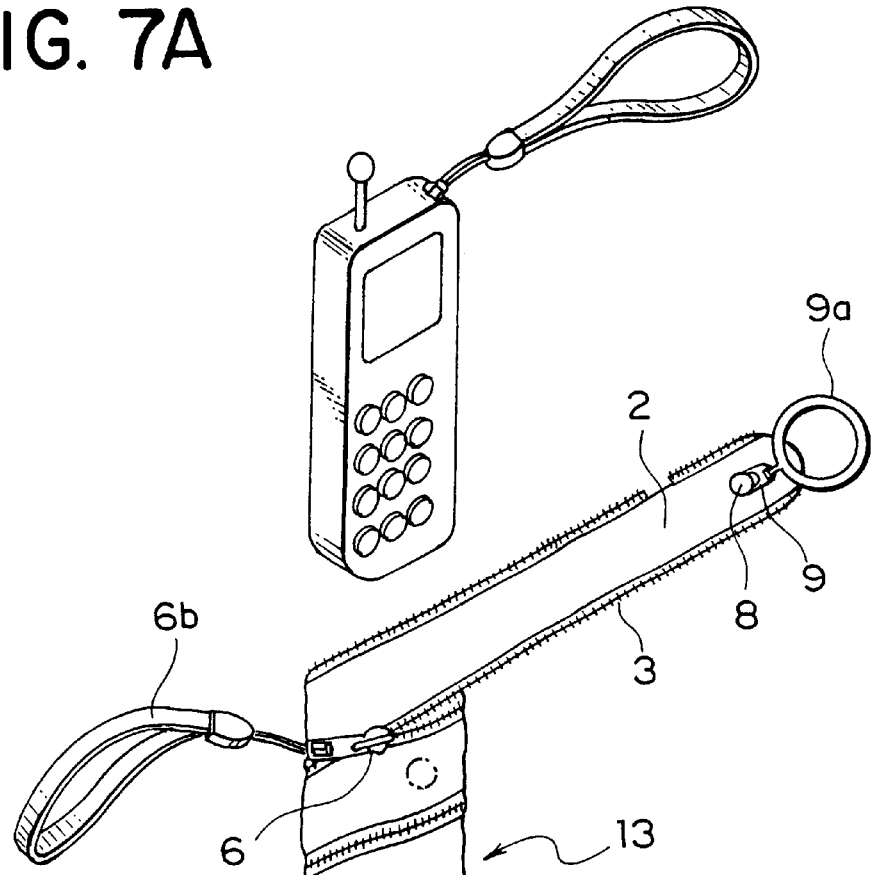
FIGS. 7A and 7B are explanatory views showing a prism-like or cylinder-like storage body and its usage manner.
Figure 7B:
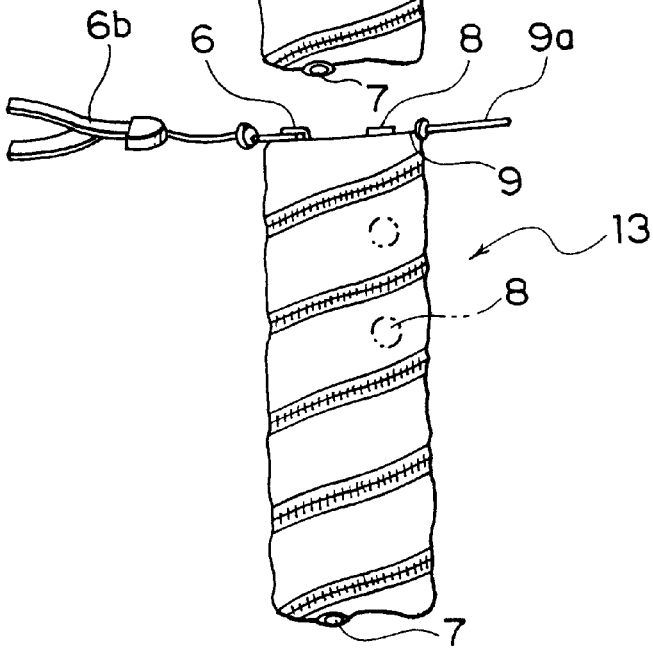

A length of the belt-like article 1 and the attaching positions of the separable bottom end stop 4 and the upper stopper device 5 are automatically determined depending on a configuration and a dimension of a storage body that can be obtained by winding the belt-like article 1 spirally and successively engaging the fastening elements with each other. For example, if it is intended to obtain a regular triangular pyramid shaped storage body 11 as shown in FIG. 5, the attaching positions of the separable bottom end stop 4 and the upper stopper device 5 are respectively located at substantially ⅛ positions of the entire length of the belt-like article 1 from both ends of the belt-like article 1. In the case of a rectangular box shaped storage body 12 as shown in FIG. 6, the attaching positions of the separable bottom end stop 4 and the upper stopper device 5 are respectively located at substantially ⅕ positions of the entire length of the belt-like article 1 from both ends of the belt-like article 1. Further, in the case of a prism or cylinder shaped storage body 13 as shown in FIGS. 7A and 7B, the separable bottom end stop 4 and the upper stopper device 5 are attached at positions substantially 1/11 of the entire length of the belt-like article 1, although it may differ depending on the width of the belt-like article 1 and the length of the prism or cylinder body. These are only exemplifications and may be changed depending on the width and length of the belt-like article 1.

Figure 3:
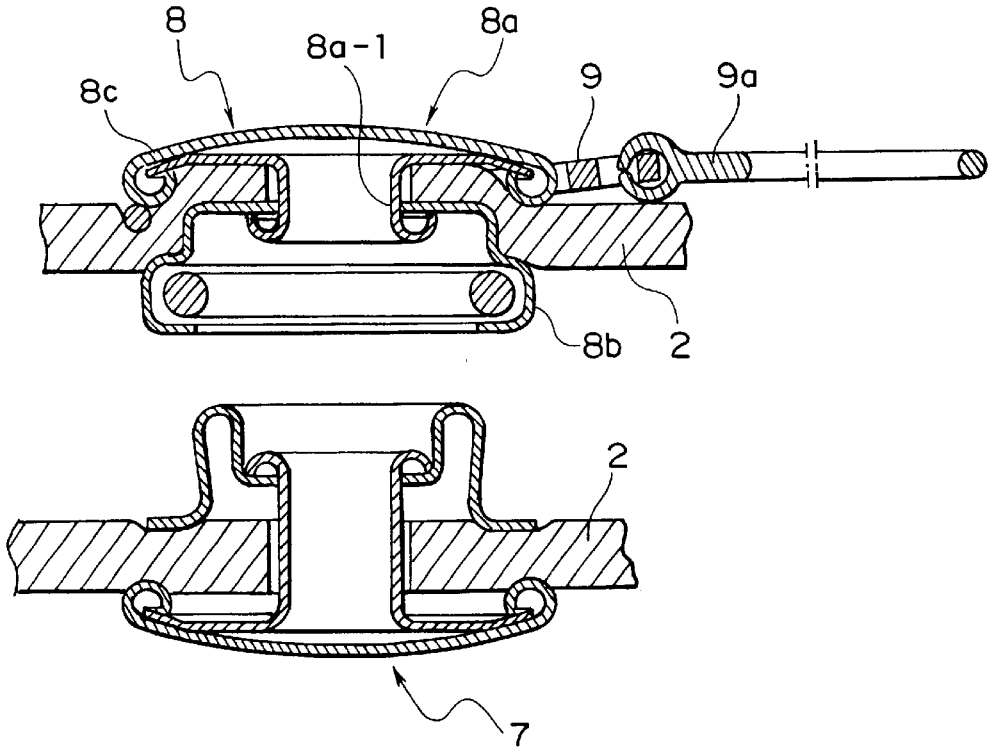
FIG. 3 is a partial sectional view showing an attachment condition of the male/female engaging members, which are engaging means of the present invention.
Figure 4:
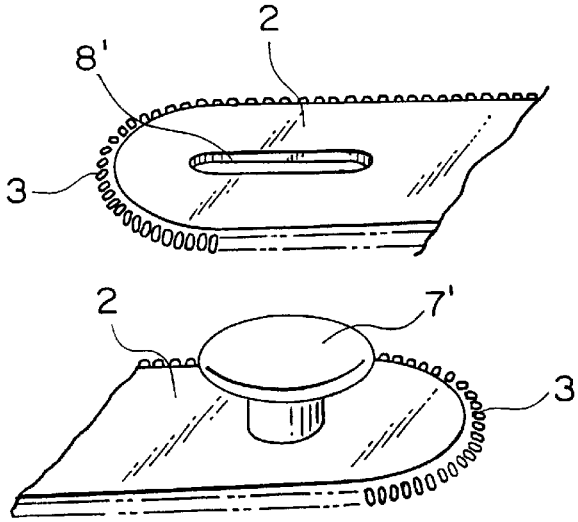
FIG. 4 is a partial perspective view showing a modified example of a case where an ordinary button and button hole are used as engaging means.

A first feature of the present invention employing the belt-like article 1 having such a structure is in that male/female engaging members 7, 8 are attached to both end portions in the longitudinal direction of the belt-like article 1 as shown in FIGS. 1 and 2. In this illustrated example, the male/female engaging members 7, 8 are composed of male/female engaging members having a conventionally known snap button structure as shown in FIG. 3. Further, in this embodiment, a joint device 9 for joining with another object is attached to a lid side of the female engaging member 8. The joint device 9 can be also attached to the male engaging member 7. In this embodiment, an engaging portion of the male engaging member 7 is located on a front side of the belt-like article 1, while an engaging portion of the female engaging member 8 is located on a rear side of the belt-like article 1 so that the rear face and the front face of the belt-like article 1 can be engaged with each other. As the engaging means of the present invention, it is possible to use an ordinary button 7' and a button hole 8' as shown in FIG. 4, in place of the aforementioned male/female engaging members 7, 8 having such a snap button structure. In this case, the button 7' and the button hole 8' constitutes engaging portions that can be engaged with or disengaged from each other.

The aforementioned joint device 9 is formed in a substantially Θ shape. The method of fixing this joint device 9 to the male or female engaging member 7, 8 will now be described. As shown in FIG. 3, a rivet column 8*a*-1 of a rivet portion 8*a* with a cap 8*c* of the female engaging member 8 is inserted into an opening in a center of a snap eyelet 8*b* through the tape main body 2, and then, the rivet portion 8*a* and the snap eyelet 8*b* are crimped so as to be attached on the tape main body 2. Before this procedure, the rivet column 8*a*-1 is inserted into an opening at one side of the aforementioned joint device 9. Then, upon the crimping, the joint device 9 is fixed by the crimping in such a manner that a periphery of the opening at the one side of the joint device 9 is nipped between the cap 8*c* and the tape main body 2. According to this embodiment, a metallic ring 9*a* is attached to the joint device 9.

Next, a method for creating the storage bodies 11 to 13 using the belt-like article 1 having the above described structure will be described. First, the belt-like article 1 is folded at a region of a predetermined length at an end portion of the belt-like article 1, i.e. a region including the separable bottom end stop 4 as a center. The insert pin 4*a* of the separable bottom end stop 4 is inserted into the box body 4*b* through the slider 6, thereby assembling the separable bottom end stop 4. Then, the slider 6 is slid successively along the periphery of the belt-like article 1 spirally so as to engage the opposing coupling elements with each other successively, until the slider 6 abuts the upper stopper device 5 finally. Consequently, the storage bodies 11 to 13 having the above-described structure can be created easily by this sliding operation of the slider.

Figure 8:
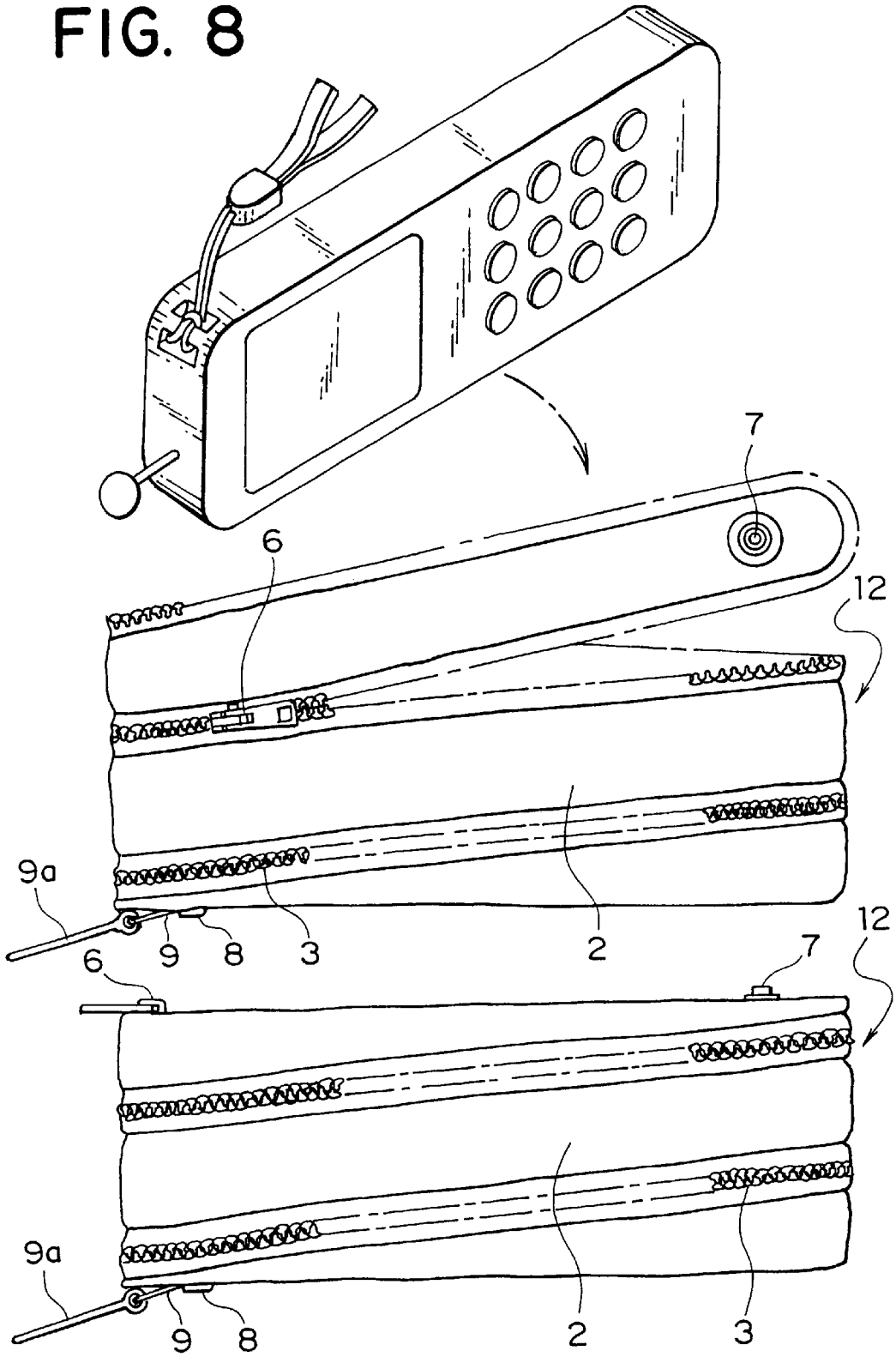
FIG. 8 is an explanatory view showing a manner in which the rectangular box-like storage body is used as a storage case for a portable phone.
Figure 9:
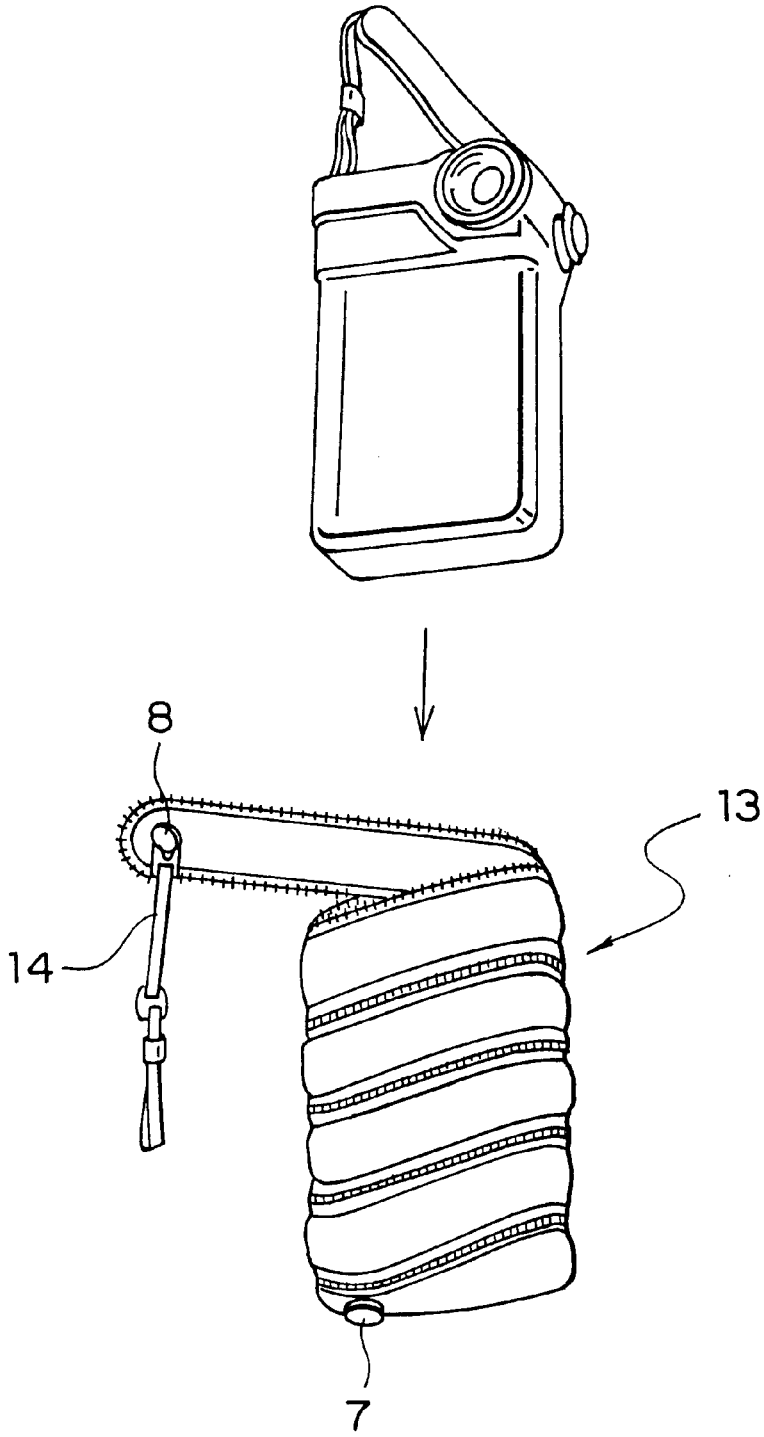
FIG. 9 is an explanatory view showing a manner in which the prism-like or cylinder-like storage body is used as a storage case for a digital camera.
Figure 10:
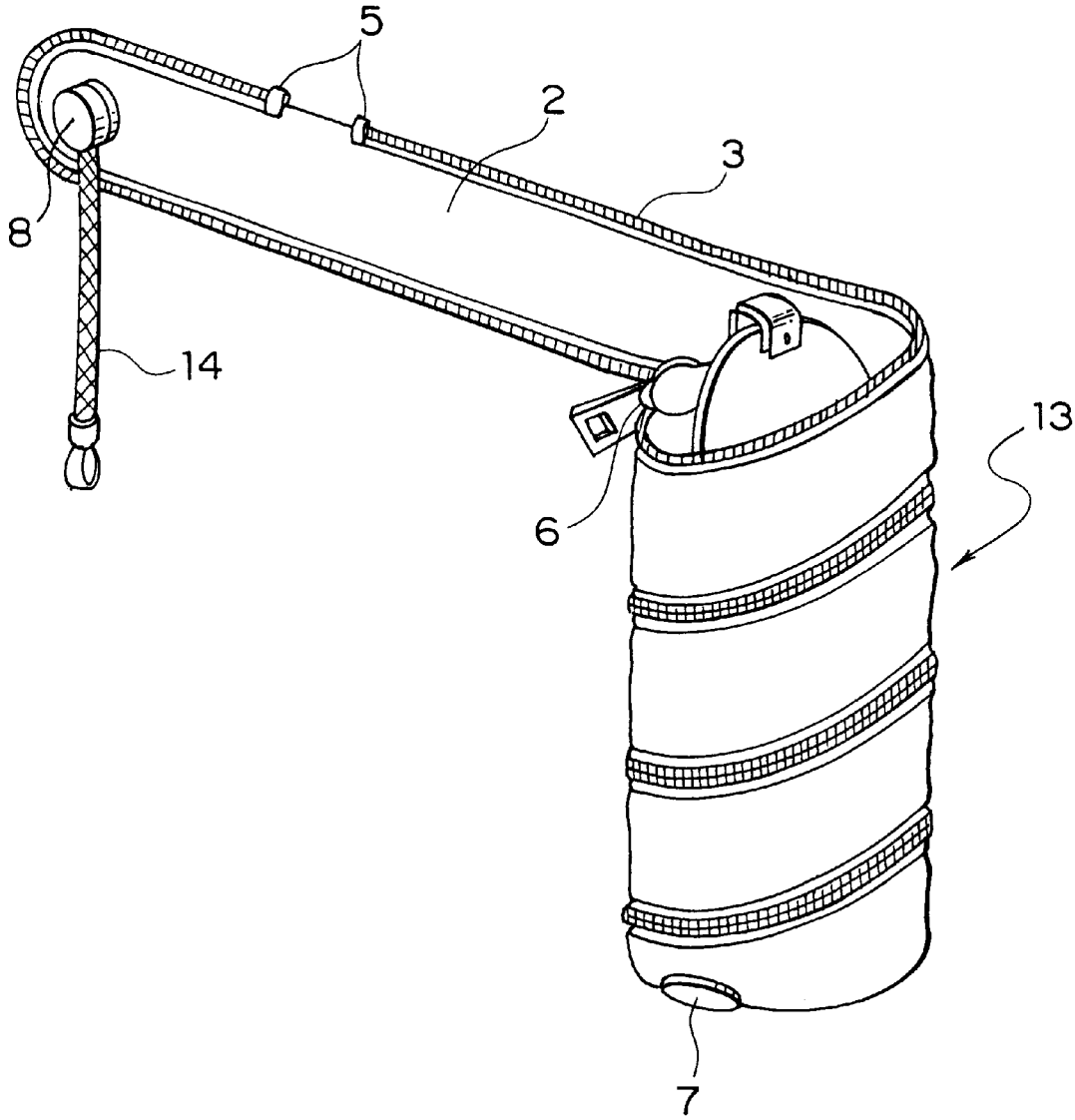
FIG. 10 is an explanatory view showing a manner in which the prism-like or cylinder-like storage body is used as a storage case for glasses.

If each of the storage bodies 11 to 13 is, for example, a triangular pyramid shaped storage body 11, it can carry such a small object as cosmetics therein. If it is a rectangular box shaped storage body 12, it can be used as a storage case for a portable phone, a small camera, cigarettes or the like as shown in FIG. 8. If it is a prism or cylinder shaped storage body 13, it can be used as a storage case for a portable phone, a collapsible umbrella, glasses, a digital camera or the like as shown in FIGS. 7, 9 and 10. Further, a narrow hanging strap 6*b* may be attached to a pull 6*a* of the slider 6 of each of the storage bodies 11 to 13 as shown in these Figures.

If it is intended to provide the aforementioned storage bodies 11 to 13 with design or fashionability, the coupling elements with the tape, which are to be attached to the periphery of the belt-like article 1, are provided with a color different from that of the tape main body 2 so that the spiral pattern can be distinct. Alternatively, the tape main body 2 may be printed with various patterns. If it is desired to express oneself, a tape main body 2 with no pattern is prepared and his or her initial letters, photograph, logo mark or the like may be printed on a surface of the tape main body 2. This can be achieved easily by means of for example, a jet printer or heat transcribing.

In order to return the storage bodies 11 to 13 obtained in this way to its original shape of belt-like article 1, the slider 6 is slid in an opposite direction and fit to the separable bottom end stop 4. Here, if the insert pin 4*a* is removed from the slider 6 and the box body 4*b*, the end portion of the belt-like article 1 initially folded back is returned to its original shape, so that a single straight belt-like article 1 is regained. According to the present invention, this straight belt-like article 1 can be used for diversified applications, which will be described below, other than the above-mentioned bodies 11 to 13, by using the male/female engaging members 7, 8 and the joint device 9.

Figure 11:
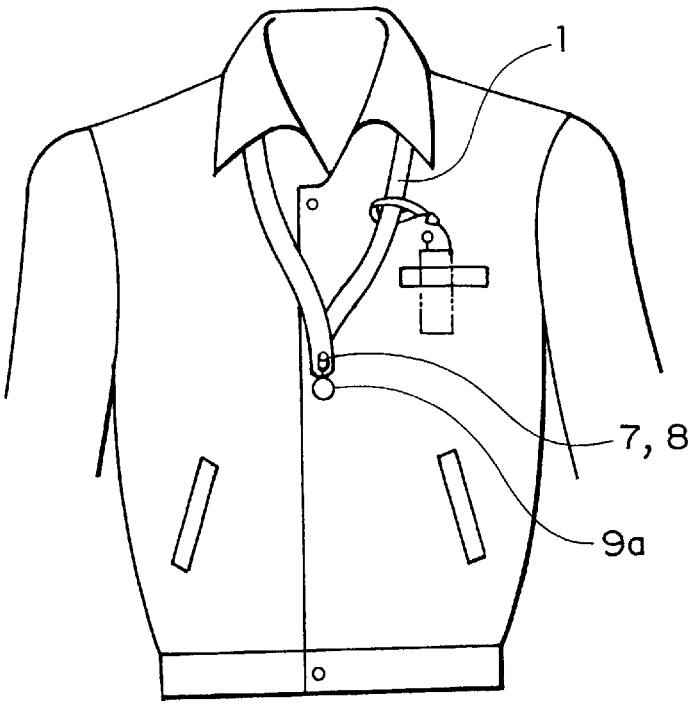
FIG. 11 is an explanatory view showing a usage manner of a neck strap that can be obtained by engaging male/female engaging members, which are attached to both end portions of the belt-like article, with each other.
Figure 12:
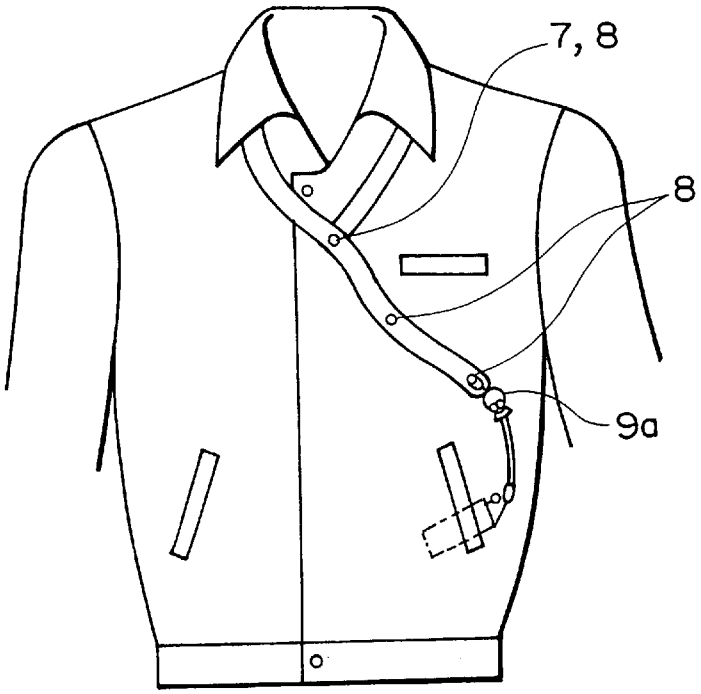
FIG. 12 is an explanatory view showing a usage manner of a neck strap that can be obtained by engaging an engaging member attached to an end portion of the belt-like article with an engaging member attached in a center of the tape main body.

FIGS. 11 and 12 show a usage manner of a ring-like body produced when the ON above-mentioned male/female engaging members 7, 8, which are attached at both end portions or in intermediate portion of the belt-like article 1, are engaged with each other. As shown in these FIGS., the aforementioned ring-like body is hung around a neck as a neck strap. Then, it can be used as an accessory by itself, or it can be used for hanging a portable phone, camera or any other object, which can be stored in the storage bodies 11 to 13, therefrom via various straps attached to these objects.

Figure 13:
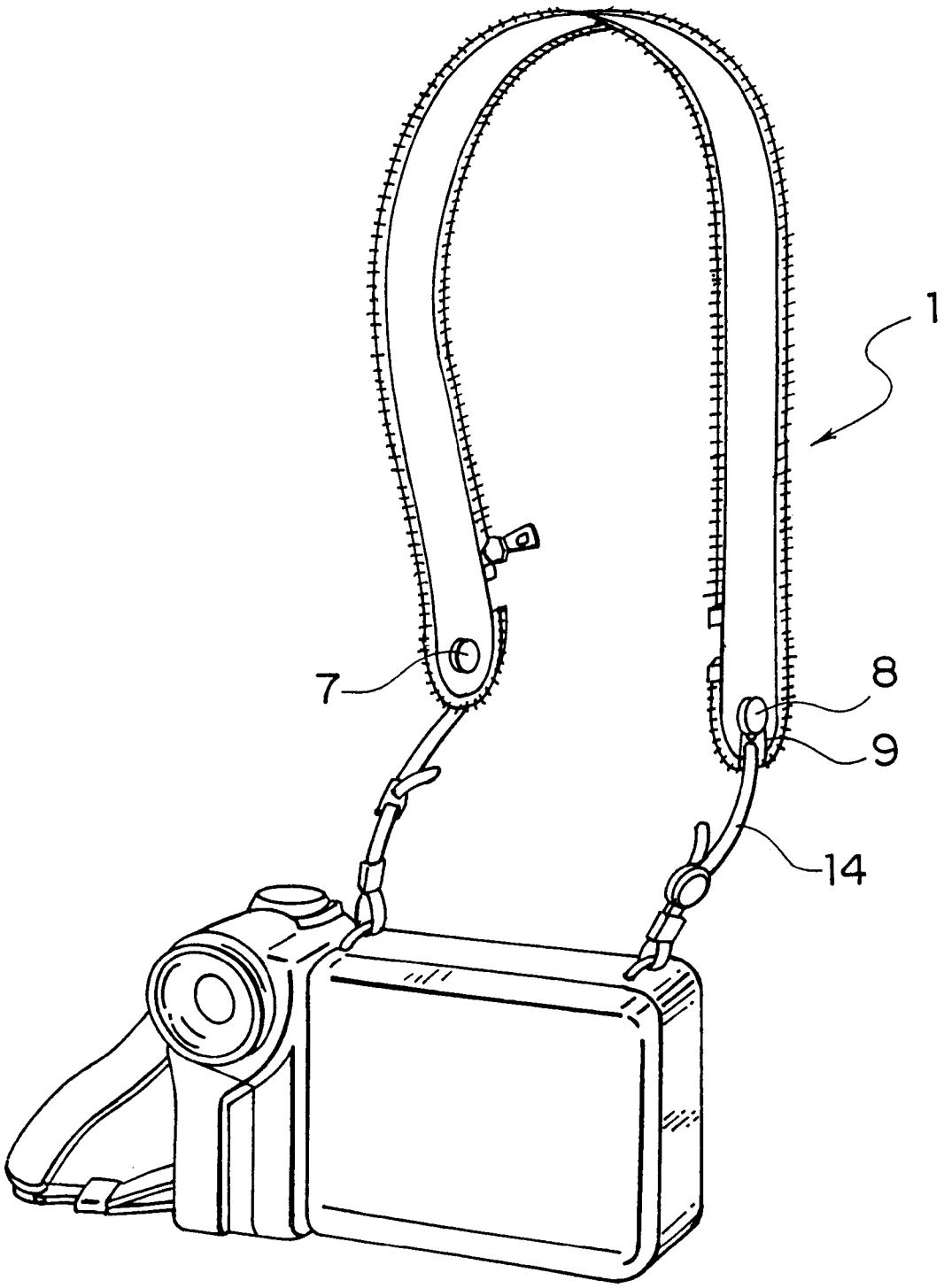
FIG. 13 is a solid view showing an example of a manner in which the belt-like article is used as a neck strap for hanging and holding a digital camera.
Figure 14:
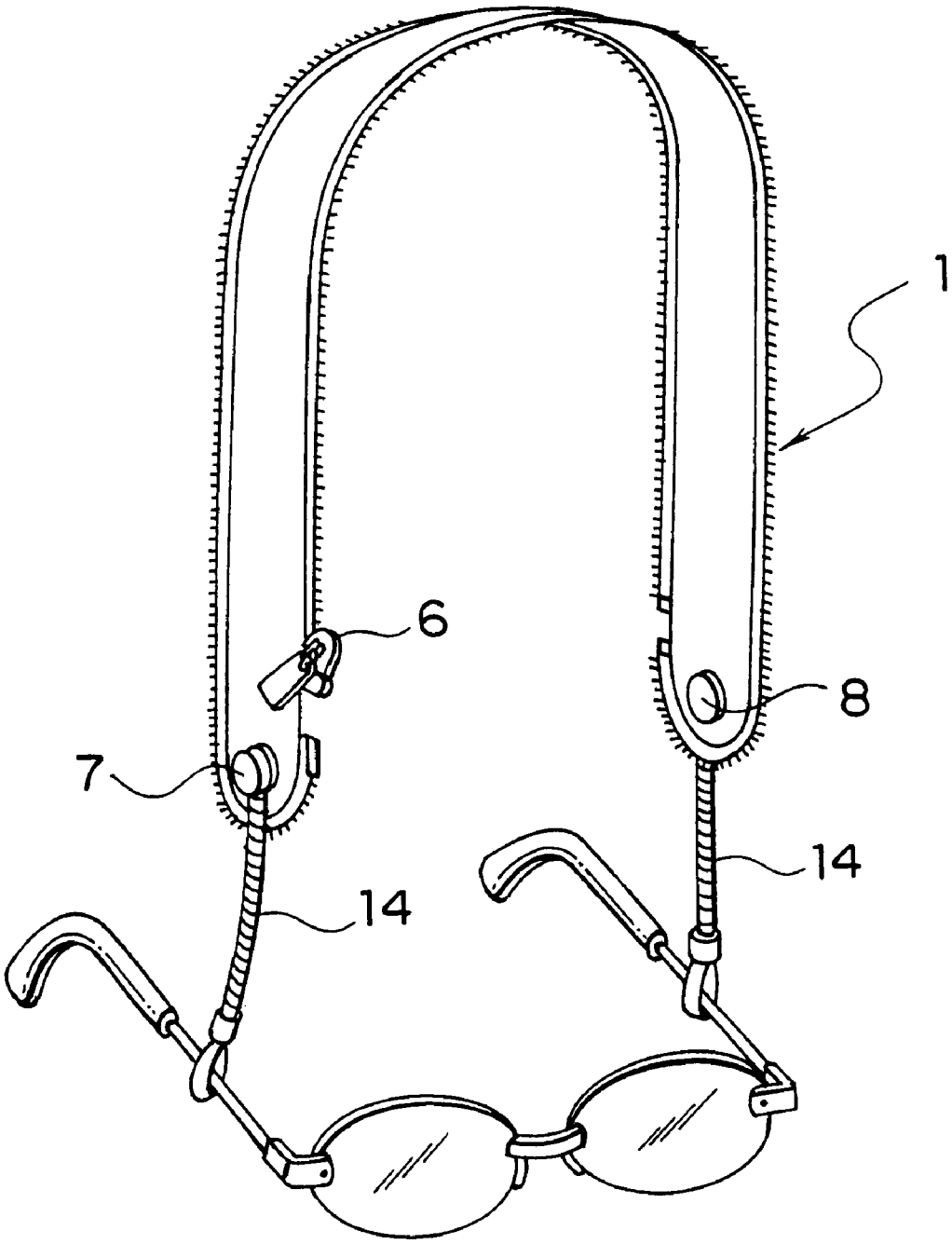
FIG. 14 is a solid view showing an example of a manner in which the belt-like article is used as a neck strap for hanging and holding glasses.

If the joint device 9 is attached to the male/female engaging members 7, 8 of the belt-like article 1 respectively, as shown in FIGS. 13 and 14, a narrow strap 14, which is attached to each of the joint devices 9 fixed at both ends of the belt-like article 1 or which is directly attached to the male/female engaging members 7, 8, is also attached to the temples of glasses, a digital camera or the like. Then, the belt-like article 1 may be used as a shoulder strap or an object hanging strap. That is, the belt-like article 1 has both functions as a storage case and a shoulder strap or an object hanging strap, which are indispensable for the glasses, digital camera and the like.

Meanwhile, when the belt-like article 1 of the present invention is used as a storage body, it can accommodate a portable phone, glasses, a camera, a portable radio, a portable player or the like, which is likely to be damaged and whose function may be seriously affected if thus damaged, as described above. The slider 6, which is usually made of metal, can make a sliding contact with the portable phone, glasses or a camera during the sliding operation or storage so that they may get damaged. Therefore, the slider 6 of the belt-like article 1 used as the storage body is desired to be made of hard synthetic resin.

The same thing can be said of the male/female engaging members and the joint device. When the belt-like article 1 of the present invention is used as the storage body, the male/female engaging members 7, 8 may expose at least inner faces thereof. In order to prevent a stored object from being damaged by the engaging portions of the male/female engaging members 7, 8 and the joint device 9, it is desirable that the male/female engaging members 7, 8 and the joint device 9 are made of synthetic resin.

Figure 15:
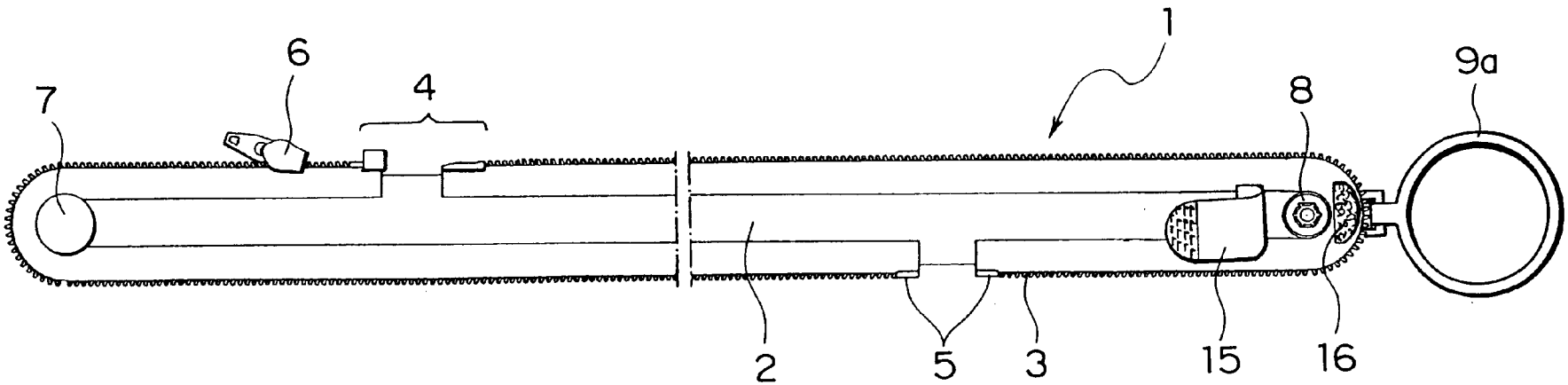
FIG. 15 is a rear view showing an example of an attachment condition of a covering body for protecting a stored object when the belt-like article is used as a storage body.

On the other hand, in the case of the belt-like article 1, which stores a heavy object such as a digital camera, a portable CD player or an MD player as mentioned above and is used as a shoulder strap, it is necessary to secure a sufficient engaging strength of the male/female engaging members 7, 8 and a self-strength of the joint device 9. For the reason, it is sometimes inevitable to use metallic material for the male/female engaging members 7, 8 and the joint device 9. FIG. 15 shows a modified example of the above embodiment, which aims to protect a stored object from damage.

Referring to FIG. 15, the female engaging member 8 is attached at an end portion of the belt-like article 1 on a side where the upper stopper device 5 is attached, such that its engaging portion is exposed on a rear face of the tape main body 2. The male engaging member 7 is attached at the other end portion on a side where the separable bottom end stop 4 is attached, such that its engaging portion is exposed on a front face of the tape main body 2. In this modified example, the engaging portion of the female engaging member 8 may damage a stored object and therefore, an end of a male tape piece 15*a* of a short strip-like surface fastener is sewed or bonded to one side of peripheral end portions of the rear face including the engaging portion of the female engaging member 8 on the tape main body 2. Then, a female tape piece 16 of the surface fastener, which engages the male tape piece 15, is attached on the other side of the peripheral end portions of the rear face. When the belt-like article 1 is used as a storage body, the male tape piece 15 is engaged with the female tape piece 16 so as to cover the engaging portion of the female engaging member 8 exposed on the rear face.

When the belt-like article 1 is used as the storage bodies 11 to 13, the engaging portions of the male/female engaging members 7, 8, and possibly the joint device 9, which are supposed to be exposed on the inner faces of the storage bodies 11 to 13, are covered with the male tape piece 15. As a result, the engaging portions of the male/female engaging members 7, 8 do not make a direct contact with an object stored in the storage bodies 11 to 13, but only makes contact therewith through the male tape piece 15. Thus, the surface of the object does not get damaged. Although its illustration is omitted, it is possible to use a self-fastening surface fastener tape, in which hook-like male fastening elements and loop-like fastening elements are mixedly present on a surface of the tape. In this case, after the belt-like article 1 is regained by releasing engagement of the coupling elements of the storage bodies 11 to 13, the tape can be folded and self-engaged, so that the tape can be fit to the rear face of the tape main body 2 of the belt-like article 1. As a result, the appearance thereof as an accessory strap is never harmed when the belt-like article 1 is used as a neck strap as described above.

Figure 16:
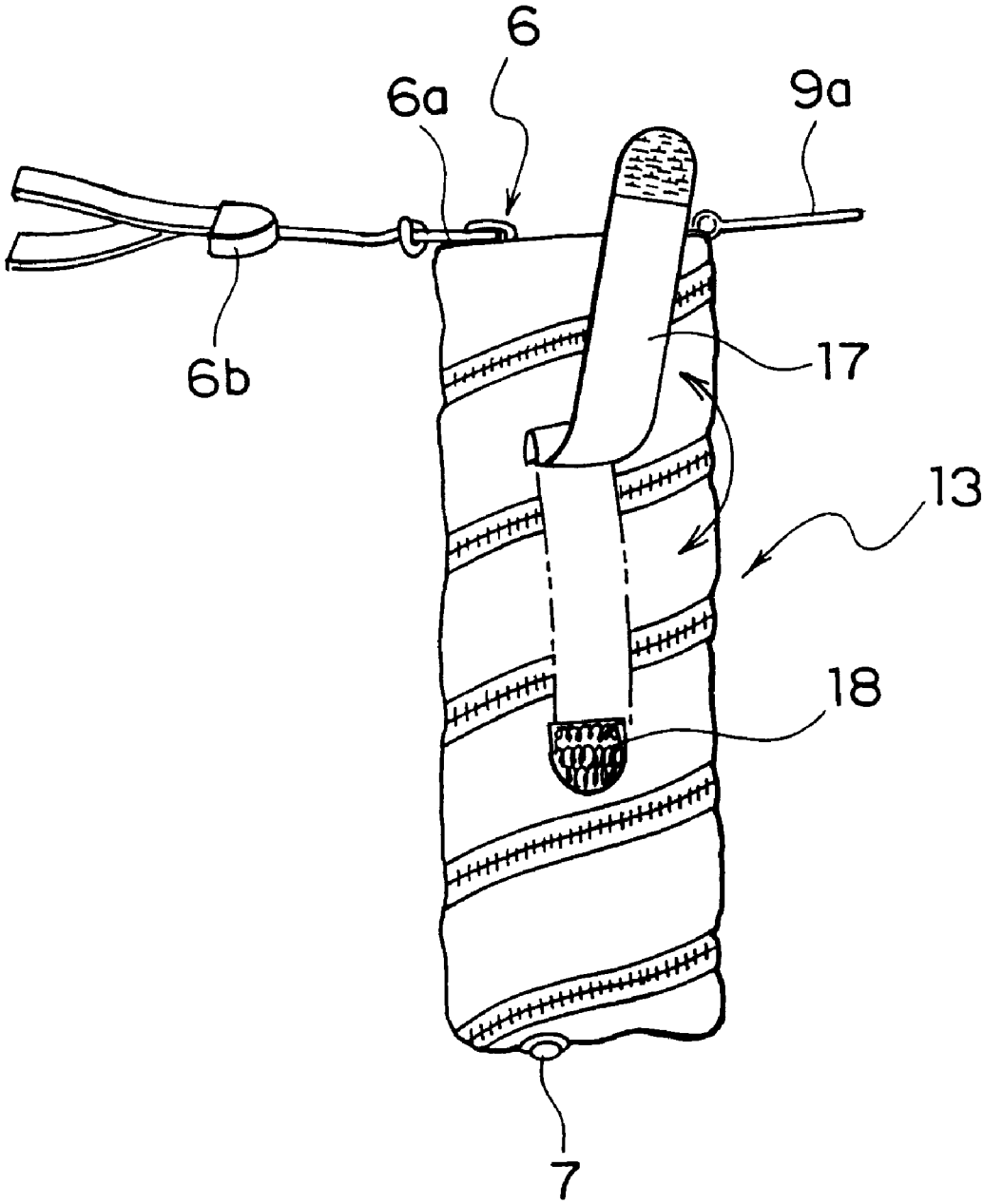
FIG. 16 is a partial perspective view showing an example of an attachment condition of an insertion portion for a belt or the like, provided on a surface of the storage body that can be obtained from the belt-like article.

FIG. 16 shows a further modified example of the above embodiment. According to this modified example, an end of the strip-like tape piece 17 is attached to the surface of the tape main body 2 of the belt-like article 1, while the other end thereof is extended beyond the belt-like article 1. The face of the strip-like tape piece 17, which opposes the belt-like article 1, has a self-fastening surface fastener, in which a plurality of fine hook-like pieces and loop-like pieces are provided mixedly. When the tape piece 17 is folded back and pressed, the hook-like pieces and the loop-like pieces come to engage each other.

On the other hand, as shown in FIG. 16, when the storage body 13 is formed from the belt-like article 1, a small piece 18 of a surface fastener, which has a plurality of loop-like pieces for engaging with an engaging face of the short strip-like tape piece 17 or which has hook-like pieces and loop-like pieces like the short strip-like tape piece 17, is attached to a corresponding position of the belt-like article 1 where the other end portion of the short strip-like tape piece 17 with one end portion fixed to the belt-like article 1 is to be disposed.

As mentioned above, an end of the short strip-like tape piece 17 is attached to the tape main body 2 of the belt-like article 1 while the other end thereof is disposed so as to be attachable to/detachable from the other part of the belt-like article 1. Then, when an object is accommodated in the storage body 13, the other end of the short strip-like tape piece 17 is joined to the small piece 18 of the surface fastener on the surface of the storage body 13, and a waist tightening belt is inserted into a space formed between the tape main body 2 and the short strip-like tape piece 17 for example. Then, the storage body 13 can be held at the waist portion with the object stored therein. Further, when the exemplified belt-like article 1 is used as a neck strap, if the short strip-like tape piece 17 is folded back inward to engage the opposing faces with each other, the short strip-like tape piece 17 does not droop from the belt-like article 1. Therefore, the short strip-like tape piece 17 does not become an obstacle or does not harm its fashionable appearance.

Further, although its illustration is omitted here, an end of the short strip-like tape piece 17 may be fixed to the surface of the belt-like article 1 along a length thereof while the other end is attachable to the small piece 18 of the surface fastener fixed on the surface of the belt-like article 1 in the same manner as mentioned above, or both ends of the short strip-like tape piece 17 may be fixed to the belt-like article 1. Then, the storage bodies 11 to 13 can be held at the waist portion as described above. Further, if this is used as a neck strap in order to hang a portable player or the like from the neck strap, a long lead wire of an earphone connected to the player may be tied up and inserted in between the tape main body 2 and the short strip-like tape piece 17 to be held without causing any obstacle to operation of the player.

The aforementioned description is directed to typical embodiments and modified examples of the present invention. It can be easily understood that the present invention may be changed in various ways within a scope specified by the attached claims.

What is claimed:

1. A belt-like article having fastening elements continuously attached along an entire periphery of a long tape main body, including:

engaging means having engaging portions capable of engaging with and disengaging from each other and connectable with an object, said engaging means being provided at predetermined positions in a longitudinal direction of said tape main body, wherein the belt-like article is capable of forming a storage body for storing the object when the fastening elements are engaged, and wherein the belt-like article is capable of carrying the object when the belt-like article has a long tape shape and when the engaging means connects the object with the belt-like article.

2. A belt-like article according to claim 1, wherein said tape main body has a covering body capable of covering/exposing the engaging portion of said engaging means disposed on a rear face thereof.

3. A belt-like article according to claim 1, wherein both ends of a short strip-like tape are attached to a surface of said tape main body.

4. A belt-like article according to claim 1, wherein at least one of said engaging means has a joint device for joining the object.

5. A belt-like article according to claim 1, wherein said fastening elements are fastening elements of a slider fastener.

6. A belt-like article according to claim 1, wherein said fastening elements are composed of a male engaging member and a female engaging member, which are adapted to be pressed to or inserted into each other so as to be engaged with each other by snap action.

7. A belt-like article according to claim 1, wherein said fastening elements are comprised of a plurality of male/female fastening elements, and compose one engaging member and the other engaging member each having a plurality of male and/or female engaging elements, the engaging members making plane contact with each other by being pressed.

8. A ring-like neck strap obtained by engaging said engaging means of the belt-like article according to claim 1.

9. A hung-object supporting body obtained which is composed of the belt-like article according to claim 4, wherein the object is joined to and supported by both end portion in a longitudinal direction of the belt-like article by at least one joint device.

10. An object storage body obtained by spirally winding the belt-like article according to claim 1 about a region of a predetermined length at an end portion of the belt-like article successively, while engaging opposing fastening elements successively.

* * * * *